US006977350B2

(12) United States Patent
Chen et al.

(10) Patent No.: US 6,977,350 B2
(45) Date of Patent: Dec. 20, 2005

(54) POWER SWITCHING DEVICE TO ENABLE POWER SWITCHING BETWEEN SINGLE PHASE POWER AND THREE PHASE POWER

(75) Inventors: Jung-Fa Chen, Taipei (TW); Kuo-Chu Yeh, Taipei (TW); Yu-Kun Sun, Taipei (TW)

(73) Assignee: ACBEL Polytech Inc., Taipei (TW)

( * ) Notice: Subject to any disclaimer, the term of this patent is extended or adjusted under 35 U.S.C. 154(b) by 71 days.

(21) Appl. No.: 10/814,940

(22) Filed: Mar. 30, 2004

(65) Prior Publication Data

US 2005/0217982 A1 Oct. 6, 2005

(51) Int. Cl.[7] ..... H01H 9/00
(52) U.S. Cl. ..... 200/1 R; 200/5 R; 439/49
(58) Field of Search ..... 200/1 R, 5 R, 200/176, 11 R–1 V, 11 TC; 439/49, 510

(56) References Cited

U.S. PATENT DOCUMENTS 3,296,362 A * 1/1967 Parry ..... 174/88 R
3,496,517 A * 2/1970 Walter ..... 439/49
3,509,268 A * 4/1970 Schwartz et al. ..... 174/262
3,829,818 A * 8/1974 Iosue et al. ..... 439/510
4,450,472 A * 5/1984 Tuckerman et al. ..... 257/713
4,462,463 A * 7/1984 Gorham, Jr. ..... 165/140
4,523,086 A * 6/1985 Eilentropp ..... 219/549
4,573,067 A * 2/1986 Tuckerman et al. ..... 257/713
4,971,420 A * 11/1990 Smith ..... 385/107
5,014,002 A * 5/1991 Wiscombe et al. ..... 324/537
5,112,238 A * 5/1992 Cizin ..... 439/188
5,116,241 A * 5/1992 Sato ..... 439/511
5,169,337 A * 12/1992 Ortega et al. ..... 439/510
5,272,283 A * 12/1993 Kuzma ..... 174/262
5,655,930 A * 8/1997 Dechelette et al. ..... 439/571
5,669,787 A * 9/1997 Miyazawa ..... 439/510
6,231,354 B1 * 5/2001 Church et al. ..... 439/76.1
6,674,006 B1 * 1/2004 Linehan et al. ..... 174/72 B
2003/0038016 A1 * 2/2003 Hilal ..... 200/1 R
2004/0094394 A1 * 5/2004 Muench et al. ..... 200/14
2005/0045461 A1 * 3/2005 Sweetland et al. ..... 200/275

* cited by examiner

*Primary Examiner*—Elvin G. Enad
*Assistant Examiner*—Lisa Klaus

(57) ABSTRACT

An power switching device includes a base with input wires and output wires electrically connected to the base and opposite to the input wires, multiple conducting tubes electrically connected to and orthogonally mounted on the base, and multiple conducting plates each having holes to selectively allow an extension of some of the conducting tubes and screw holes selectively defined to correspond to and allow a bottom face of each of the screw holes to abut free ends of the rest of the conducting tubes such that screws are able to threadingly extend from the screw holes and into the free ends of the conducting tubes abutted to the bottom faces of the screw holes to secure engagement between conducting plate and the conducting tubes.

18 Claims, 8 Drawing Sheets

1

POWER SWITCHING DEVICE TO ENABLE POWER SWITCHING BETWEEN SINGLE PHASE POWER AND THREE PHASE POWER

BACKGROUND OF THE INVENTION

1. Field of the Invention

The present invention relates to a power switching device, and more particularly to a power switching device that allows for switching between single phase power and three-phase power without dismantling the electronic device.

2. Description of Related Art

In a server rack, it is normal to switch from a single phase power to a three-phase power and vice versa due to different power pattern. A terminal block is the best-known device to redistribute the power in the market. Therefore, the user is able to use the configuration of the terminal block to alter the current or an electronic signal direction so as to change the operational pattern of an electronic device. A conventional electronic device has the terminal block to control the direction of current flow or the signal so as to change the operating manner of the electronic device. With the fast speed of electronic development, electronic devices are becoming more and more complex and compact. Thus, available space is less than ever. As a consequence of available space becoming less in the modern electronic devices, the built-in wiring inside the electronic devices are extremely complex and complicated. Therefore, when proceeding maintenance or repair of the electronic devices, the users, without the proper knowledge of how the built-in wiring is constructed, often damages the electronic devices and sometimes hurt themselves.

Therefore, how should the users properly proceed the maintenance or repair of the electronic devices without damaging the electronic devices becomes the primary objective of the present invention.

To overcome the shortcomings, the present invention intends to provide a power switching device to mitigate the aforementioned problems.

SUMMARY OF THE INVENTION

The primary objective of the invention is to provide a power switching device to allow the user to change the current flow without dismantling the electronic device.

Another objective of the invention that the power switching device has multiple conducting tubes each with a height different from the others and multiple conducting plates each with multiple holes corresponding to some of the conducting tubes that pass through the conducting plates and screw holes corresponding to the rest of the conducting tubes that electrically connected to the conducting plates such that the conducting tubes are categorized into different groups each electrically connected to a corresponding one of the conducting plates to allow the user to easily change the current flow.

Other objects, advantages, and novel features of the invention will become more apparent from the following detailed description when taken in conjunction with the accompanying drawings.

DETAILED DESCRIPTION OF PREFERRED EMBODIMENT

Figure 1:
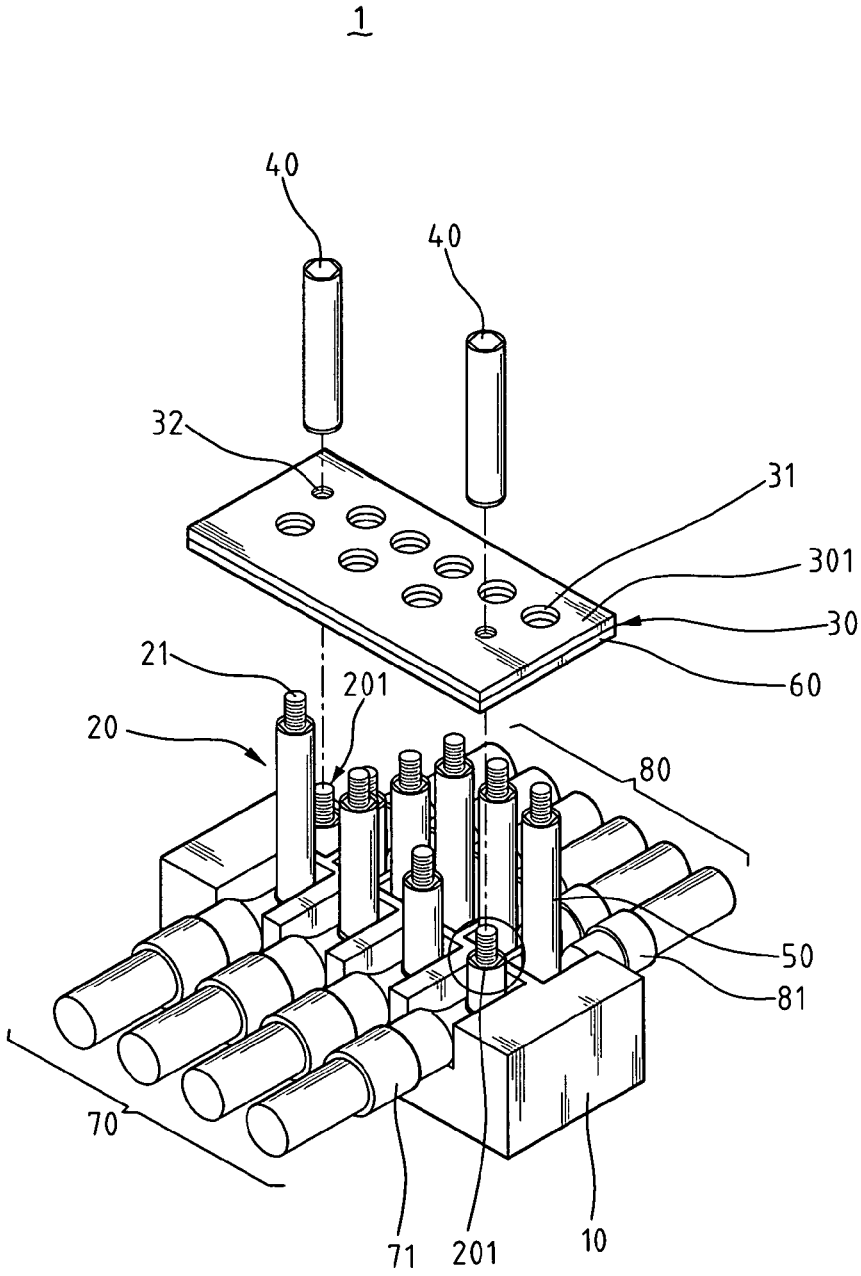
FIG. 1 is an exploded perspective view of a power switching device of the present invention with only one conducting plate shown in the drawing.

With reference to FIG. 1, it is to be noted that a power switching device 1 constructed in accordance with the present invention includes a base 10 made of metal, multiple conducting tubes 20 orthogonally mounted on a top face of the base 10, multiple conducting plates 30 (only one is shown in FIG. 1), securing bolts 40, input wires 70 and output wires 80.

Figure 1A:
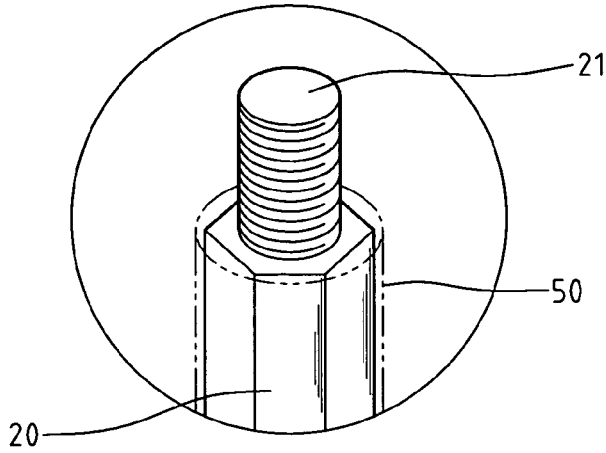
FIG. 1A is an enlarged perspective view showing that the conducting tube has an insulating layer coated outside the conducting tube and a threaded end formed on a free end of the conducting tube.
Figure 1B:
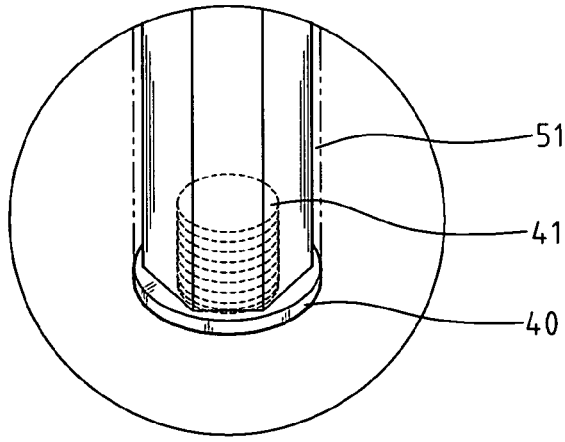
FIG. 1B is an enlarged perspective view showing that the securing bolt has a threaded recess defined in a bottom of the securing bolt to correspond to the threaded end of the conducting bolt.

With reference to FIGS. 1 and 1A, the conducting tubes 20 are orthogonal to the top face of the base 10 and each has an insulating layer 50 mounted outside the conducting tube 20. The conducting tubes 20 are classified into a first group 201, a second group 202, a third group 203 and a fourth group 204 (as shown in FIGS. 1, 2, 3, and 4) each having a unique height different from the other groups. Each conducting tube 20 of the groups is provided with a threaded end 21 formed on a free end of each conducting tube 20.

Figure 1C:
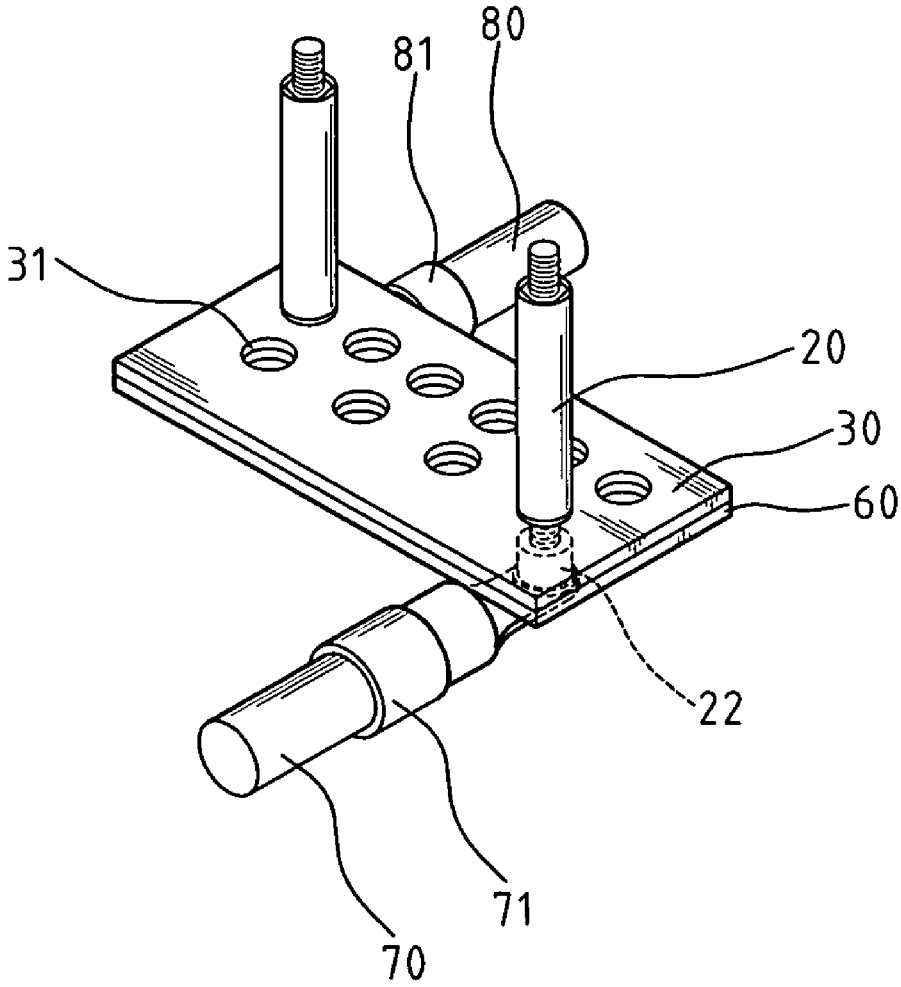
FIG. 1C is an exploded perspective view showing the combination between the conducting tube and the input wire.
Figure 2:
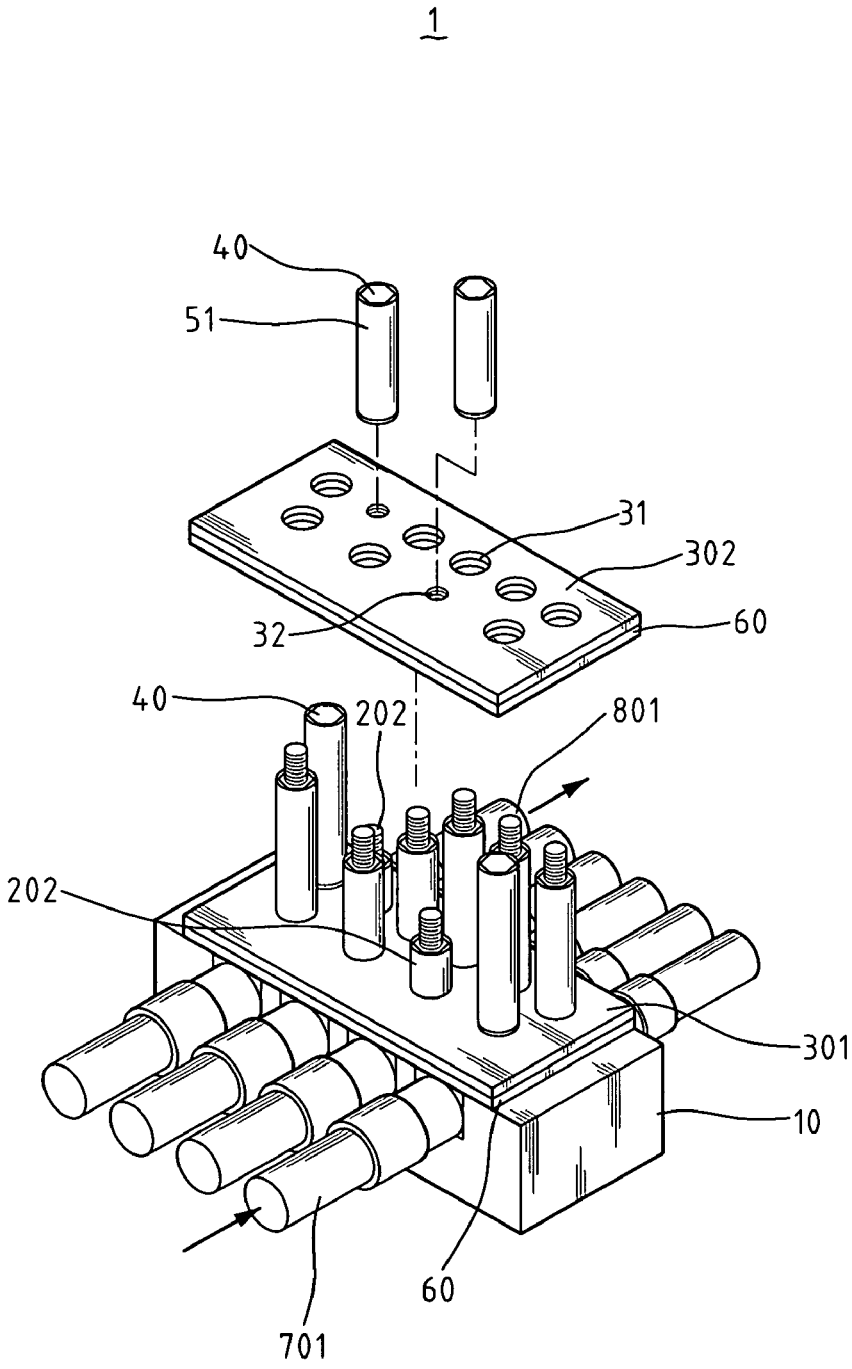
FIG. 2 is a schematic perspective view showing that the first group of conducting plate is electrically connected to the first conducting tube.
Figure 3:
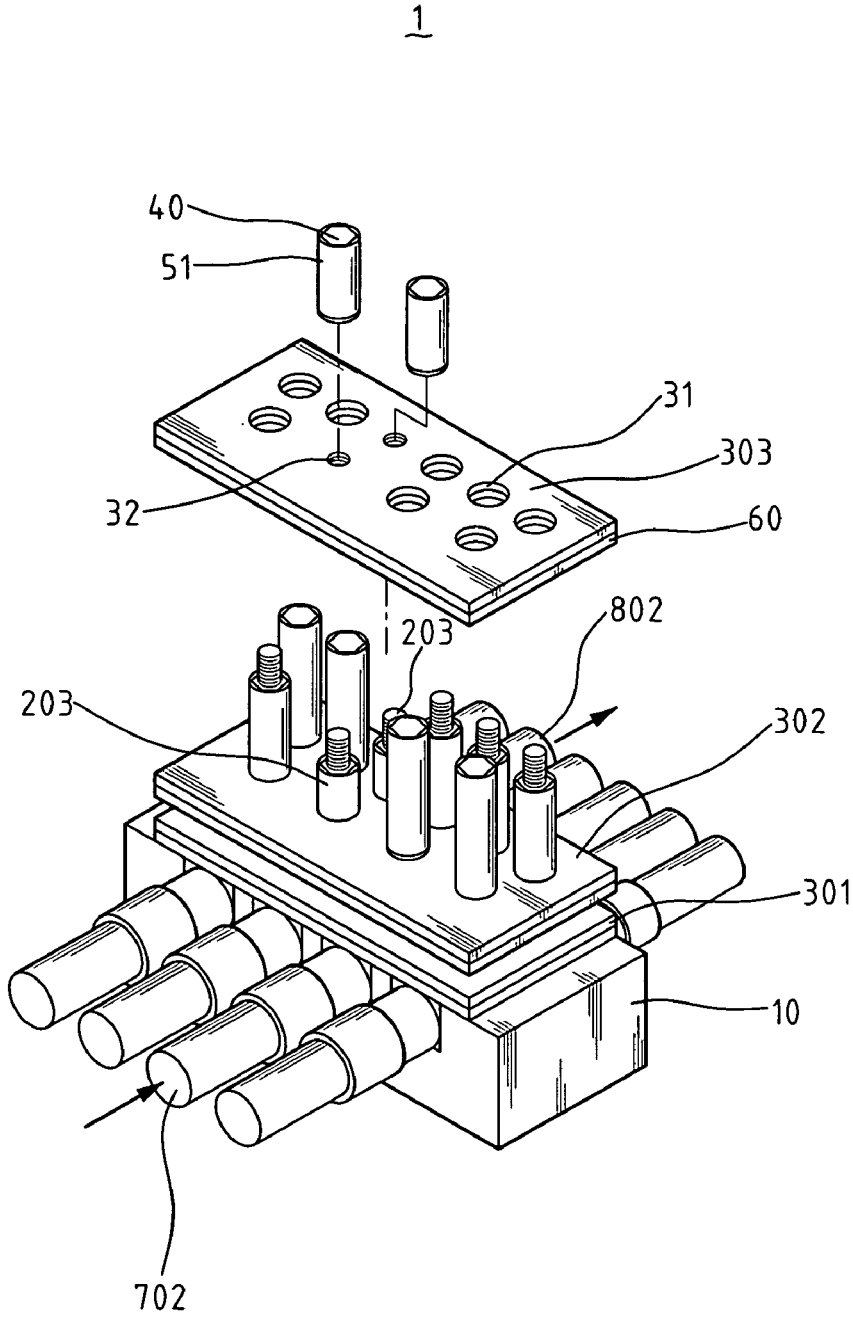
FIG. 3 is a schematic perspective view showing that the second group of conducting tubes is electrically connected to the second conducting plate.
Figure 4:
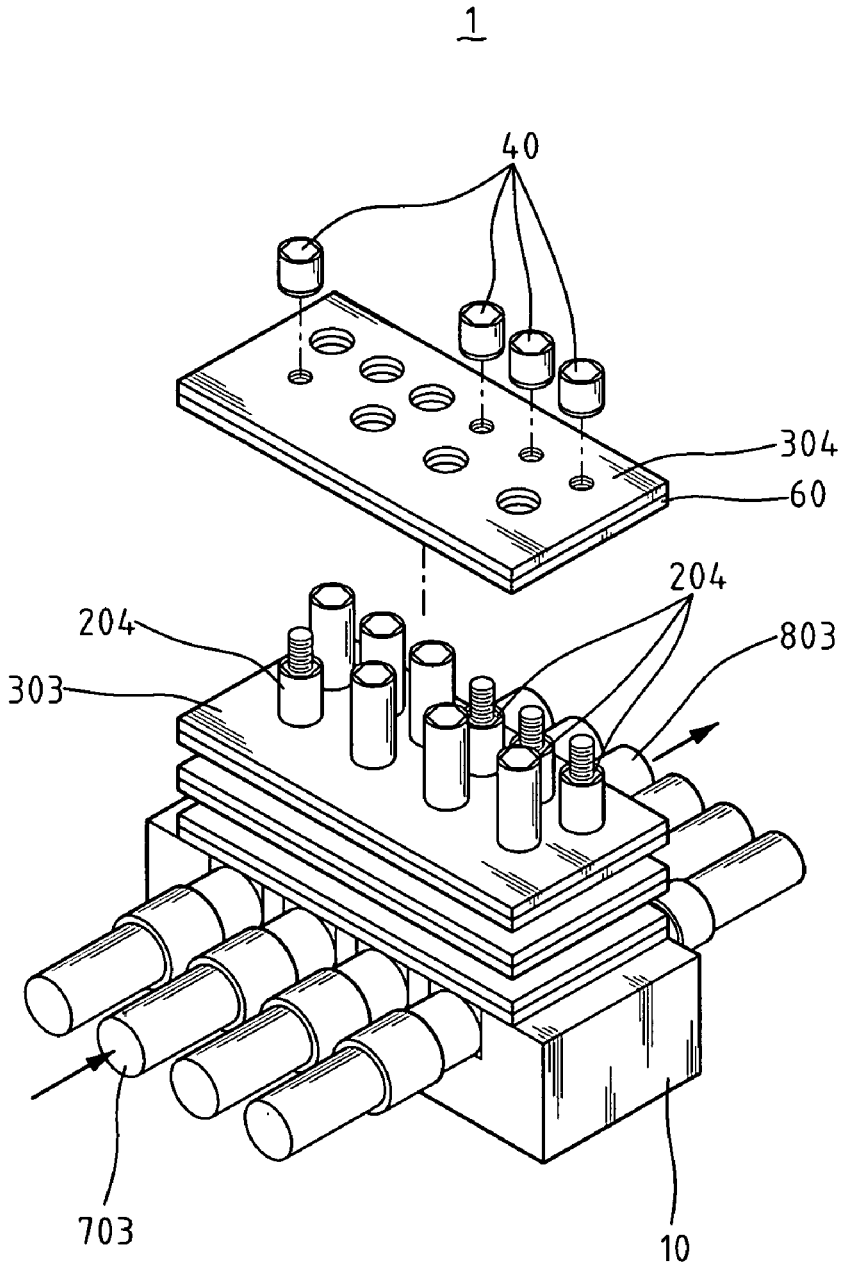
FIG. 4 is a schematic perspective view showing that the third group of conducting tubes is electrically connected to the third conducting plate.
Figure 5:
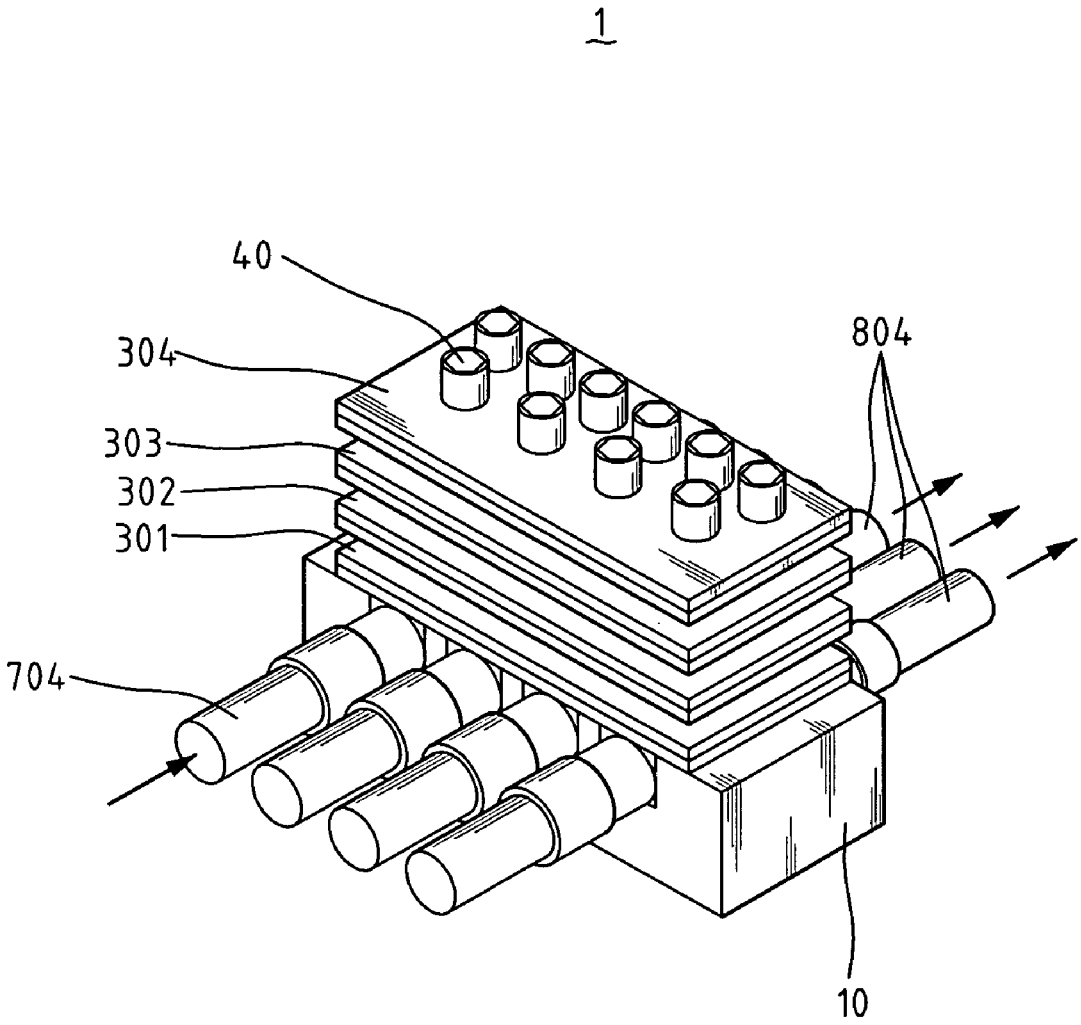
FIG. 5 is a perspective view showing that the fourth group of conducting tubes is electrically connected to the fourth conducting plate to complete the assembly of the present invention.

The conducting plates 30 are also categorized into a first conducting plate 301, a second conducting plate 302, a third conducting plate 303 and a fourth conducting plate 304 (as shown in FIGS. 1, 2, 3, and 4). Each of the conducting plates 301, 302, 303, 304 has holes 31 corresponding to the second, the third and the fourth, the first, the third and the fourth, the first, the second and the fourth and the first, the second and the third groups of the conducting tubes 20 and screw holes 32 corresponding to the threaded ends 21 of the first, the second, the third and the fourth groups of the conducting tubes 20. The securing bolt 40 has the insulating layer 50 mounted on an outer periphery of the securing bolt 40 and a threaded recess 41 defined in a bottom end of the securing bolt 40. FIG. 1C shows that the input wires 70 are electrically connected to the first, the second, the third, and the fourth groups of conducting tubes 20 and the output wires 80 are electrically connected to the first, the second, the third, and the fourth groups of conducting tubes 20. In order to prevent an electrical surge in the bottom end of the conducting tubes 20, a washer 22 is provided and sandwiched between the joint between the input wire 70 and the conducting tube 20 to increase the contact area between the input wire 70 and the conducting tube 20. In order to secure the engagement with the base 10, a terminal plate 71, 81 is provided to each of the input wire 70 and the output wire 80 such that both the input and output wires 70, 80 are securely mounted on the base 10.

With reference to FIGS. 1–5, when the power switching device is to be assembled, the second, third and fourth groups of conducting tubes 20 extend through the holes 31 of the first conducting plate 301 and the first group of conducting tubes 20 abuts bottom faces of the screw holes 32. Screws 40 are threadingly extended into the threaded free ends of the first group of conducting tubes 20 to secure the engagement between the first conducting plate 301 and the first group of conducting tubes 20. In order to prevent unwanted electrical connection between the conducting tubes 20 and the conducting plates 30, an insulating plate 60 is securely attached to a bottom face of each of the first conducting plates 301.

Then the first, third and fourth groups of conducting tubes 20 extend through the holes 31 of the second conducting plate 302 and the second group of conducting tubes 20 abuts bottom faces of the screw holes 32. Screws 40 are threadingly extended into the threaded free ends of the first group of conducting tubes 20 to secure the engagement between the second conducting plate 302 and the second group of conducting tubes 20. In order to prevent unwanted electrical connection between the conducting tubes 20 and the conducting plates 30, an insulating plate 60 is securely attached to a bottom face of each of the second conducting plates 302.

The first, second and fourth groups of conducting tubes 20 extend through the holes 31 of the third conducting plate 303 and the third group of conducting tubes 20 abuts bottom faces of the screw holes 32. Screws 40 are threadingly extended into the threaded free ends of the third group of conducting tubes 20 to secure the engagement between the third conducting plate 302 and the third group of conducting tubes 20. In order to prevent unwanted electrical connection between the conducting tubes 20 and the conducting plates 30, an insulating plate 60 is securely attached to a bottom face of each of the third conducting plates 30.

Thereafter, the fourth group of conducting tubes 20 abuts bottom faces of the screw holes 32. Screws 40 are threadingly extended into the threaded free ends of the fourth group of conducting tubes 20 to secure the engagement between the fourth conducting plate 304 and the fourth group of conducting tubes 20. In order to prevent unwanted electrical connection between the conducting tubes 20 and the conducting plates 30, an insulating plate 60 is securely attached to a bottom face of each of the fourth conducting plates 30.

After the aforementioned assembly, it is noted that the user is able to have different electrical connection between the input wires 70 and the output wires. For example, when the first group of conducting tubes 20 is employed, power is provided to the first input wire 701 and the power is transmitted to the first output wire 801. When the second group of conducting tubes 20 is employed, power is provided to the first input wire 702 and the power is transmitted to the first output wire 802. When the third group of conducting tubes 20 is employed, power is provided to the first input wire 703 and the power is transmitted to the first output wire 803. When the third group of conducting tubes 20 is employed, power is provided to the first input wire 704 and the power is transmitted to the first output wire 804. Therefore, the user is able to choose different groups to divert the power direction without using a jumper or a jump wire to change direction of the current flow.

It is to be noted that the last conducting plate (304 in this preferred embodiment) has only screw holes 32 to allow the extension of the screws 40 to secure the engagement between the fourth conducting plate 304 and the fourth group of conducting tubes 204.

Figure 6:
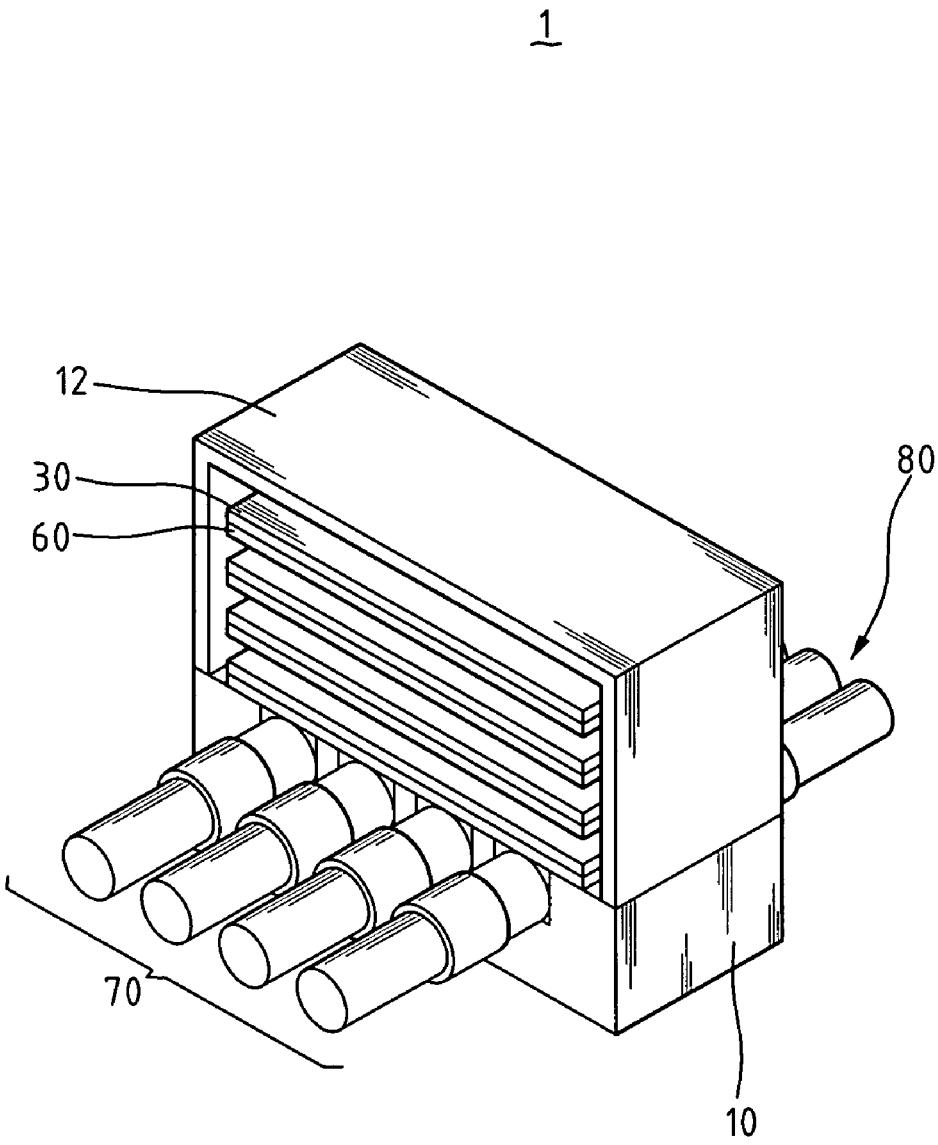
FIG. 6 is a perspective view showing that a casing is provided to the combination in FIG. 5.

With reference to FIG. 6, it is noted that in order to prevent an electrical shock, a casing 12 is provided to encase all the conducting plates 30. Preferably, the material that is used to make the casing 12 is insulative.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A power switching device comprising:

a base with input wires and output wires both electrically connected to the base and the output wire being opposite to the input wires;

multiple conducting tubes electrically connected to and orthogonally mounted on the base, the conducting tubes being classified into a first group of conducting tubes and a last group of conducting tubes, the first group of conducting tubes having a height different from that of the last group of conducting tubes;

a first conducting plate having holes defined to allow an extension of the last group and screw holes defined to correspond to and allow a bottom face of each of the screw holes to abut free ends of the first group of conducting tubes such that screws are able to threadingly extend from the screw holes and into the free ends of the first group of conducting tubes to secure engagement between the first conducting plate and the first group of conducting tubes; and a last conducting plate having last screw holes defined to correspond to and allow a bottom face of each of the last screw holes to abut free ends of the last group of conducting tubes such that last screws are able to threadingly extend from the last screw holes and into the free ends of the last group of conducting tubes to secure engagement between the last conducting plate and the last group of conducting tubes, and whereby power direction is changeable by selecting a specific input wire and sequentially a specific output wire is determined.

2. The power switching device as claimed in claim 1, wherein an insulating layer is coated to an outside of each of the conducting tubes.

3. The power switching device as claimed in claim 2, wherein a securing bolt is provided to secure engagement between the conducting tube and the conducting plate.

4. The power switching device as claimed in claim 1, wherein an insulating plate is added to the bottom face of each of the first and second conducting plates.

5. The power switching device as claimed in claim 2, wherein an insulating plate is added to the bottom face of each of the first and second conducting plates.

6. The power switching device as claimed in claim 1 further comprising a third group of conducting tubes electrically connected to and orthogonally mounted on the base and a third conducting plate sandwiched between the first and the last conducting plates and having third holes defined to allow an extension of the last group of conducting tubes and third screw holes defined to correspond to and abut free ends of the third group of conducting tubes such that third screws are able to threadingly extend from the third screw holes and into the free ends of the third group of conducting tubes to secure engagement between the third group of conducting tubes and the third conducting plate, wherein the third group of conducting tubes has a height different from the first and the second groups of conducting tubes.

7. The power switching device as claimed in claim 6, wherein an insulating layer is coated to an outside of the third group of conducting tubes.

8. The power switching device as claimed in claim 7, wherein an insulating plate is added to the bottom face of the third conducting plate.

9. The power switching device as claimed in claim 8, wherein a securing bolt is provided to secure engagement between the conducting tube and the conducting plate.

10. The power switching device as claimed in claim 9, wherein each conducting tube has a threaded end formed on a free end of the conducting tube to correspond to a threaded recess defined in a bottom end of the securing bolt so that an electrical connection between the conducting bolt and the conducting plate is completed.

11. The power switching device as claimed in claim 7, wherein a securing bolt is provided to secure engagement between the conducting tube and the conducting plate.

12. The power switching device as claimed in claim 11, wherein each conducting tube has a threaded end formed on a free end of the conducting tube to correspond to a threaded recess defined in a bottom end of the securing bolt so that an electrical connection between the conducting bolt and the conducting plate is completed.

13. The power switching device as claimed in claim 6, wherein an insulating plate is added to the bottom face of the third conducting plate.

14. The power switching device as claimed in claim 13, wherein a securing bolt is provided to secure engagement between the conducting tube and the conducting plate.

15. The power switching device as claimed in claim 14, wherein each conducting tube has a threaded end formed on a free end of the conducting tube to correspond to a threaded recess defined in a bottom end of the securing bolt so that an electrical connection between the conducting bolt and the conducting plate is completed.

16. The power switching device as claimed in claim 6, wherein a securing bolt is provided to secure engagement between the conducting tube and the conducting plate.

17. The power switching device as claimed in claim 16, wherein each conducting tube has a threaded end formed on a free end of the conducting tube to correspond to a threaded recess defined in a bottom end of the securing bolt so that an electrical connection between the conducting bolt and the conducting plate is completed.

18. The power switching device as claimed in claim 1, wherein a securing bolt is provided to secure engagement between the conducting tube and the conducting plate.

* * * * *